US008528339B2

(12) United States Patent
Morrison et al.

(10) Patent No.: US 8,528,339 B2
(45) **Date of Patent: *Sep. 10, 2013**

(54) STACKED LAMINATE GAS TURBINE COMPONENT

(75) Inventors: Jay A. Morrison, Oviedo, FL (US); Gary B. Merrill, Orlando, FL (US); Daniel George Thompson, Pittsburgh, PA (US); Steven James Vance, Orlando, FL (US)

(73) Assignee: Siemens Energy, Inc., Orlando, FL (US)

( * ) Notice: Subject to any disclaimer, the term of this patent is extended or adjusted under 35 U.S.C. 154(b) by 1377 days.

This patent is subject to a terminal disclaimer.

(21) Appl. No.: 11/784,154

(22) Filed: Apr. 5, 2007

(65) Prior Publication Data

US 2010/0251721 A1 Oct. 7, 2010

(51) Int. Cl.
*F04D 29/54* (2006.01)

(52) U.S. Cl.
USPC ..... 60/753; 60/805; 415/173.1; 415/200

(58) Field of Classification Search
USPC ..... 60/753, 796, 797, 805; 415/173.1, 415/200
See application file for complete search history.

(56) References Cited

U.S. PATENT DOCUMENTS

| | | | | |
|---|---|---|---|---|
| 4,109,031 | A | 8/1978 | Marscher | |
| 4,422,648 | A | 12/1983 | Eaton et al. | |
| 4,521,496 | A | 6/1985 | Sara | |
| 4,596,116 | A | 6/1986 | Mandet et al. | |
| 4,646,810 | A | 3/1987 | Lardellier | |
| 4,759,687 | A | 7/1988 | Miraucourt et al. | |
| 4,805,398 | A | 2/1989 | Jourdain et al. | |
| 5,062,767 | A | 11/1991 | Worley et al. | |
| 5,137,421 | A | 8/1992 | Hayton | |
| 5,183,270 | A | 2/1993 | Alten et al. | |
| 5,226,209 | A | 7/1993 | Baker | |
| 5,289,677 | A | 3/1994 | Jarrell | |
| 5,291,732 | A | 3/1994 | Halila | |
| 5,364,543 | A | 11/1994 | Bosna et al. | |
| 6,105,966 | A | 8/2000 | Turnquist et al. | |
| 6,109,616 | A | 8/2000 | Mayr | |
| 6,113,349 | A | 9/2000 | Bagepalli et al. | |
| 6,502,825 | B2 | 1/2003 | Aksit et al. | |
| 6,655,695 | B1 | 12/2003 | Sund et al. | |
| 6,726,448 | B2 | 4/2004 | McGrath et al. | |
| 6,746,755 | B2 * | 6/2004 | Morrison et al. | 428/166 |
| 6,758,653 | B2 | 7/2004 | Morrison | |
| 6,761,937 | B2 * | 7/2004 | Tului et al. | 427/450 |
| 6,910,853 | B2 | 6/2005 | Corman et al. | |
| 6,918,594 | B2 | 7/2005 | Sund et al. | |
| 7,153,096 | B2 * | 12/2006 | Thompson et al. | 415/200 |
| 7,452,189 | B2 * | 11/2008 | Shi et al. | 416/226 |
| 7,534,086 | B2 * | 5/2009 | Mazzola et al. | 415/173.1 |
| 2002/0081195 | A1 | 6/2002 | Wolfe et al. | |
| 2005/0158171 | A1 * | 7/2005 | Carper et al. | 415/200 |

* cited by examiner

*Primary Examiner* — Andrew Nguyen

(57) ABSTRACT

A stacked laminate component for a turbine engine that may be used as a replacement for one or more metal components is provided. The stacked laminate component can have a body formed by a process of stacking and laminating layers to define a radially inner surface along the hot gas path. The layers can be substantially orthogonal to the radially inner surface. The layers can be at least a first layer of a first material and a second layer of a second material. At least the first material is a ceramic matrix composite. The second material can have a higher thermal conductivity or a higher creep strength than the first material.

19 Claims, 2 Drawing Sheets

STACKED LAMINATE GAS TURBINE COMPONENT

FIELD OF THE INVENTION

This invention is directed generally to ceramic articles, and more particularly to ceramic articles that may be used in a turbine system as a replacement for metal components.

BACKGROUND OF THE INVENTION

Conventional gas turbine engines operate at high temperatures and therefore, many of the systems within the engine are formed from metals capable of withstanding the high temperature environments. For example, gas turbine systems often include ring segments that are stationary gas turbine components located between stationary vane segments at the tip of a rotating turbine blade or airfoil. Ring segments are exposed to high temperatures and high velocity combustion gases and are typically made from metal. While the metal is capable of withstanding the operating temperatures, the metal is often cooled to enhance the usable life of the ring segments. Many current ring segment designs use a metal ring segment attached either directly to a metal casing or support structure or attached to metal isolation rings that are attached to the metal casing or support structure. More recently, firing and/or operating temperatures of turbine systems have increased to improve engine performance. As a result, the ring segments have required more and more cooling to prevent overheating and premature failure. Even with thermal barrier coatings, active cooling is still necessary.

Ceramic materials, such as ceramic matrix composites, have higher temperature capabilities than metal alloys and therefore, do not require the same amount of cooling, resulting in a cooling air savings. Prior art ring segments made from CMC materials rely on shell-type structures with hooks or similar attachment features for carrying internal pressure loads. U.S. Pat. No. 6,113,349 and U.S. Pat. No. 6,315,519 illustrate ring segments with C-shaped hook attachments. Conventional ceramic matrix components are formed from layers of woven fibers positioned in planes and layers substantially parallel to the inner sealing surface of the ring segments. For cooled components, internal pressurization would load these attachment hooks in such a way as to cause high interlaminar tensile stresses. Other out-of-plane features common in laminated structures, such as T-joints, are also subject to high interlaminar stresses when loaded. One of the limitations of laminated ceramic matrix composite (CMC) materials, whether oxide or non-oxide based, is that their strength properties are not generally uniform in all directions (e.g. the interlaminar tensile strength is generally less than about 5% of the in-plane strength). Nonuniform fiber perform compaction in complex shapes and anisotropic shrinkage of matrix and fibers results in delamination defects in small radius corners and tightly curved sections, further reducing the already-low interlaminar properties. A further limitation of shell-type CMC construction is that the through-thickness thermal conductivity is lower than the in-plane conductivity, particularly for oxide based CMC's. Many applications of CMC require cooling, preferably convective cooling on one side, removing heat by through-thickness conduction.

An alternative to shell like CMC structures is to orient the CMC limited laminated structures in a configuration so as to minimize the negative effects of anisotropy. In this configuration laminated structures are oriented so that the fiber ends are normal to the gas path surfaces thereby eliminating the concern of poor interlaminar properties. Such orientation is referred to as stacked laminated structures. Stacked laminate construction does however have some drawbacks. It results in higher raw material use and thus higher waste as compared to other construction methods. Intricate shaping of the component is possible using the stacked laminate construction but cutting to form the shape results in wasted ceramic fabric during the fabrication process. The contemporary cutting practices used in stacked laminate construction typically results in a component having a greater amount of total ceramic fiber content. Such wasted ceramic fiber during cutting and greater ceramic fiber contents in the components greatly increases the cost of turbine components made from stacked laminate construction. Due to the cost of the materials, there is often a trade-off between the cost of the component and the desired properties of the component, such as higher thermal conductivity or higher creep strength.

Thus, a need exists for construction methods and structures for laminated ceramic composite components having a lower cost. There is a further need for such components having improved properties, such as higher thermal conductivity or higher creep strength. In addition, a need exists for a ceramic article that may be used as a replacement material for metal parts in turbine systems to improve the efficiencies of the turbine systems.

SUMMARY OF THE INVENTION

The exemplary embodiments described herein are directed to a stacked laminate component that may be used as a replacement for one or more metal components used in a turbine engine. The stacked laminate component can achieve multiple effects in a single structure by combining materials and selectively positioning those materials in accordance with critical and non-critical areas of the component. Lower cost components can also be achieved through use of lower cost materials being layered with superior materials, where the superior materials are generally positioned in the critical areas of the component.

In one aspect, a gas turbine component exposed to a hot gas path of a gas turbine is provided comprising a body with a radially inner surface along the hot gas path and a radially outer surface. The body has a plurality of layers being generally orthogonal to the radially inner surface. The plurality of layers comprise at least a first layer formed from a first material and a second layer formed from a second material. The first material is a ceramic matrix composite.

In another aspect, a gas turbine component exposed to a hot gas path of a gas turbine is provided comprising a body formed by a process of stacking and laminating layers to define a radially inner surface along the hot gas path. The layers can be generally orthogonal to the radially inner surface. The layers may be at least a first layer of a first material and a second layer of a second material. At least the first material is a ceramic matrix composite. The second material can have at least one of a higher thermal conductivity or a higher creep strength than the first material.

In another aspect, a method of manufacturing a gas turbine component is provided comprising: providing at least a first material and a second material; stacking and laminating the first and second materials to define a body comprising layers; and cutting the body. The first material is a ceramic matrix composite. The second material has at least one of a higher thermal conductivity or a higher creep strength than the first material. The first and second materials are arranged in alternating layers along at least a portion of the body. The layers are substantially orthogonal to a radially inner surface of the body.

The second material can be a ceramic matrix composite. The first and second layers may be positioned in an alternating pattern along the body. The second layer can be recessed from the first layer along the radially inner surface. The component can further comprise a coating on the radially inner surface, with the first layer extending into the coating. The first layer may be recessed from the second layer along the radially outer surface. The second layer may extend into the coating.

The component can further comprise an overwrap that imparts a compressive preload on the body. The overwrap can be designed to utilize a combination of properties of thermal expansion and processing shrinkage to provide a compressive preload on the body. The overwrap may be a ceramic matrix composite. The overwrap can be formed from a material having either a higher, or neutral coefficient of thermal expansion than the plurality of layers. The second material may be a sapphire fiber felt or a mullite whisker felt. The first and second layers may be positioned in an alternating pattern along at least a portion of the body. The component can be a ring seal segment, an airfoil, a platform, a vane or a combustor heat shield.

These and other embodiments are described in more detail below.

BRIEF DESCRIPTION OF THE DRAWINGS

The accompanying drawings, which are incorporated in and form a part of the specification, illustrate embodiments of the presently disclosed invention and, together with the description, disclose the principles of the invention.

DETAILED DESCRIPTION OF THE INVENTION

Embodiments of the invention are directed to a construction for a ceramic matrix composite (CMC) turbine engine component. Aspects of the invention will be explained in connection with a ring seal segment, but the detailed description is intended only as exemplary. Embodiments of the invention are shown in FIGS. 1-4, but the present invention is not limited to the illustrated structure or application.

Figure 1:
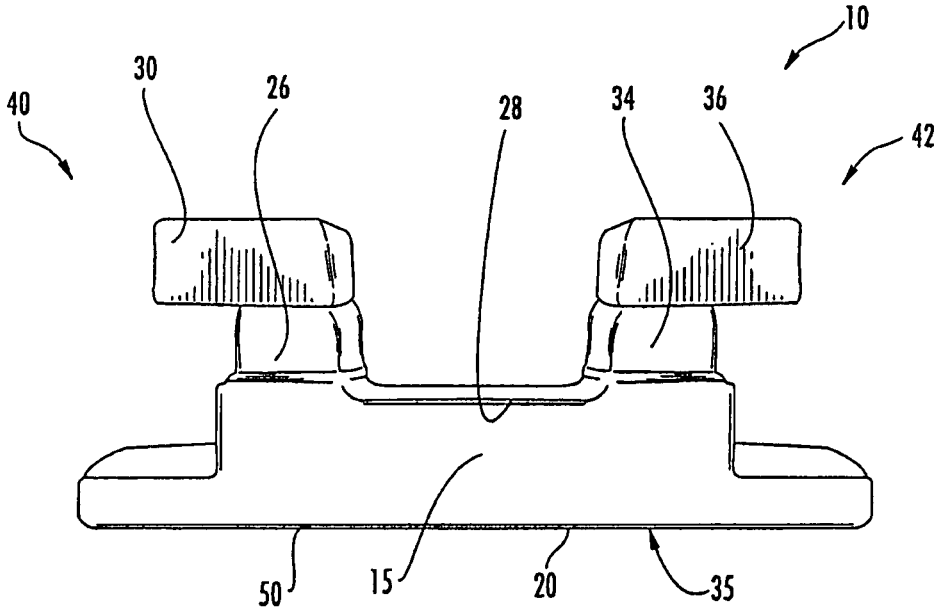
FIG. 1 is a front view of a ceramic matrix composite stacked laminate gas turbine component according to an exemplary embodiment of the invention.
Figure 2:
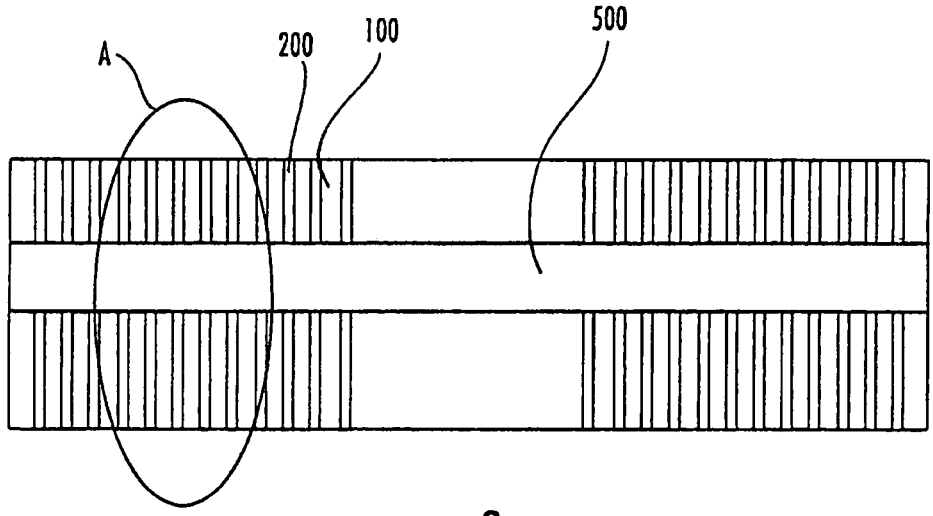
FIG. 2 is a side view of a portion of the component of FIG. 1 showing an exemplary embodiment of the stacked laminate construction of the invention.
Figure 3:
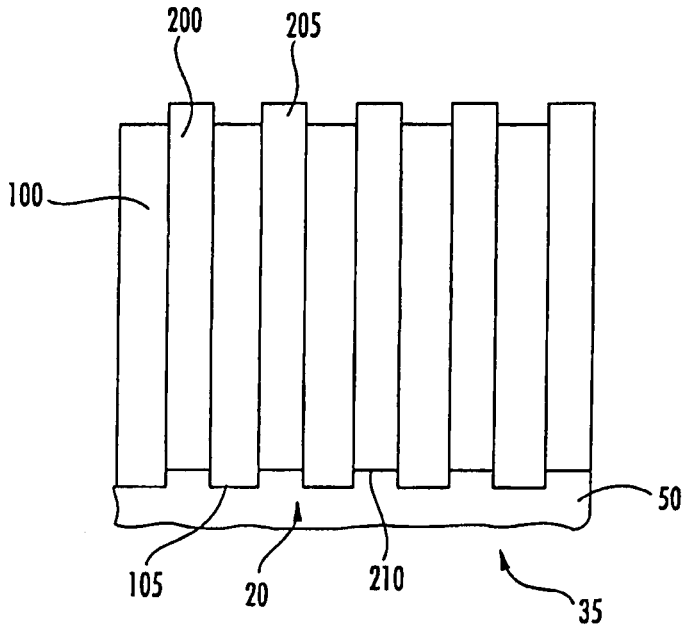
FIG. 3 is an enlarged cross-sectional view of portion A of the component of FIG. 2 showing an exemplary embodiment of the stacked laminate construction of the invention without the fiber overwrap.

Referring to FIGS. 1 through 3, a ceramic matrix component is shown and generally represented by reference numeral 10. The exemplary embodiment describes by way of example a CMC stacked laminate gas turbine component as a ring seal segment 10 for the turbine section of the gas turbine. However, it should be understood that the present disclosure contemplates gas turbine components of stacked laminate construction for other sections of the turbine engine, such as, for example, vanes, airfoils, vane platforms, combustor heat shields and the like.

Ring seal segment 10 can be used as a replacement for one or more metal components used in a turbine engine. Ring seal segment 10 can be formed from a plurality of layers 100 and 200 that are oriented unconventionally. For example, and as shown more clearly in FIG. 2, the layers 100 and 200 can be positioned generally or substantially orthogonal to an inner sealing surface or hot gas path side 20 such that the layers are orthogonal to the hot gas path 35 of the gas turbine. Such a configuration of layers 100 and 200 allows use of hooks and other attachment features where the loading is resisted by the CMC in the strongest direction of the CMC. In addition, the weaker interlaminar bonds are oriented in the lowest load direction of the ring segment 10.

As shown in FIG. 1, the ring seal segment 10 can include a first foot 26 positioned on a backside surface 28 at a first end 40. The backside surface 28 can be generally opposite the inner sealing surface 20. The first foot 26 can extend generally orthogonally from the backside surface 28 and can include an outer attachment section 30. The ring seal segment can also include a second foot 34 positioned on the backside surface 28 at a second end 42. The second foot 34 can extend generally orthogonally from the backside surface 28 and can include an outer attachment section 36. Outer attachment sections 30 and 36 can be used for attachment to the gas turbine by an attachment structure (not shown). Such attachment structures are known in the art.

The ring seal segment 10 can include an abradable and/or insulative coating 50 on the inner sealing surface 20. The coating 50 can be any conventional or not yet developed abradable and/or insulative coating. The coating 50 can be attached to the inner sealing surface 20 through any appropriate method, such as, for example, an intermediate adhesive layer or other bond-enhancing material, and can include insulative properties in some embodiments. The coating 50 can be, for example, a friable graded insulation (FGI). Various examples of FGI coatings are disclosed in U.S. Pat. Nos. 6,676,783; 6,670,046; 6,641,907; 6,287,511; 6,235,370; and 6,013,592.

The coating 50 can be applied over at least a portion of the inner sealing surface 20. In one embodiment, the coating 50 can completely cover the inner sealing surface 20. The thickness of the coating 50 can be substantially uniform, but, in some cases, it can be preferred if the thickness of the coating 50 is non-uniform. The variation in thickness of the coating 50 can occur in one or more directions, or it can vary in localized regions.

Layers 100 and 200 have differing properties that allow for selective control of the characteristics of the ring seal segment 10 in different portions of the segment. For example, layer 100 can be a CMC having high temperature tolerances and high strength such as NEXTEL 720 fiber reinforced alumina composite (A-N720) made by COI Ceramics Inc. Layer 200 can be a material having a higher thermal conductivity than layer 100. For example, layer 200 can be a monolithic or CMC such as (A-N610) made by COIC Ceramics Inc. (A-N191) made by Saint Gobain, a ceria-based refractory or other relatively high thermally conductive materials. Such materials can be stacked with layer 100 to enhance the heat transfer from the hot gas path 35 to the backside surface or cool side 28 of the ring seal segment 10.

To further increase the heat transfer surface area and the convection coefficient, the layers 200 can protrude or extend beyond the layers 100 along the cool side 28 as shown at ends 205 of the layers 200. Layer 200 can also be recessed from the layers 100 along the hot gas path side or inner sealing surface 20 as shown at ends 210 of the layers 200. By recessing ends 210, layers 200 can be protected from the higher temperatures to which the inner sealing surface 20 is exposed. This is especially significant where materials are being used for layers 200 that have high thermal conductivity but only limited temperature tolerance.

To enhance the bond between the coating 50 and the inner sealing surface 20 of the ring seal segment 10, the ends 105 of layers 100 can protrude into the coating. Such an arrangement provides greater surface area for adhesion of the coating 50 to the inner sealing surface 20, with the added benefit of giving a mechanically interlocking feature that provides additional bonding benefits for the coating material 20.

Portion A of FIG. 2 shows layers 100 and 200 arranged in alternating columns. However, the present disclosure contemplates the use of other patterns of layers 100 and 200. Ring seal segment 10 can also have more than two layers of different materials. The particular arrangement of layering can be chosen to focus the superior properties of the materials on those portions of the ring seal segment 10 or other gas turbine component that can take the most advantage of the properties. The exemplary embodiment has one layer that is made from a CMC material as described above. The additional layer or layers can be CMC or other such materials that allow for multiple effects through material properties to be achieved in a single structure.

For example, layers 200 having higher thermal conductivity can be arranged in an alternating pattern with layers 100 along the mid-section 15 of the ring seal segment 10, while the adjacent ends 40 and 42 of the ring seal segment are composed only of layers 100. Such a non-uniform arrangement of the layers 100 and 200 can increase the heat transfer along the mid-section 15 where the cool side 28 is in proximity to the hot gas path side 20 while maintaining strength along the ends 40 and 42 of the ring seal segment 10 that are in proximity to the attachment sections 30 and 36. This results in lower average temperatures of layers 100 thereby improving the usable strength of this layer.

Ring seal segment 10 can have layers 100 and 200 of substantially equal thickness as shown in FIG. 3. However, the present disclosure contemplates the use of varying thicknesses of layers 100 and 200. For example, layers 200 of increased thickness can be positioned along mid-section 15 to enhance heat transfer between the inner sealing surface 20 and the cool or backside surface 28, while layers 200 of decreased thickness can be used along ends 40 and 42 of the ring seal segment 10 where there is less need for heat transfer. Similarly, the thickness of layer 100 or the thickness of any additional layers of materials that are utilized in ring seal segment 10 can be varied. An example of where layer 100 might need to be thicker would be at either end of the laminated structure which might typically be exposed to higher thermal stresses.

Layers 100 and 200 can also be chosen so as to make ring seal segment 10 more cost effective. For example, layer 100 can be a CMC having high temperature tolerances and strength such as NEXTEL 720 fiber reinforced alumina composite (A-N720) made by COI Ceramics Inc. Layer 200 can be a material having a lower cost than that of layer 100. For example, layer 200 can be a monolithic or CMC such as AS-N550 made by COIC Ceramics Inc. (A-N191) made by Saint Gobain, FGI, ZIRCAR fiber board, a ceria-based refractory or other cost effective materials. Such materials can be stacked with layer 100 to reduce the overall cost of the ring seal segment 10. Where the cost effective material has lower temperature tolerance, layers 200 can be protected from the higher temperatures to which the inner sealing surface 20 is exposed by being recessed from the layers 100 along the inner sealing surface as shown at ends 210 of the layers 200. The pattern of layering of the cost effective material of layers 200 with respect to layers 100 can be chosen so as to position the layers 200 in the less critical areas of the ring seal segment 10 and position layers 100 in the more critical areas. The critical areas can include those areas of ring seal segment 10 that are exposed to higher temperatures and those areas that are exposed to higher stresses. Although, the present disclosure contemplates defining critical areas for positioning of the layers 100 based upon the particular superior properties of the material of layers 100.

Figure 4:
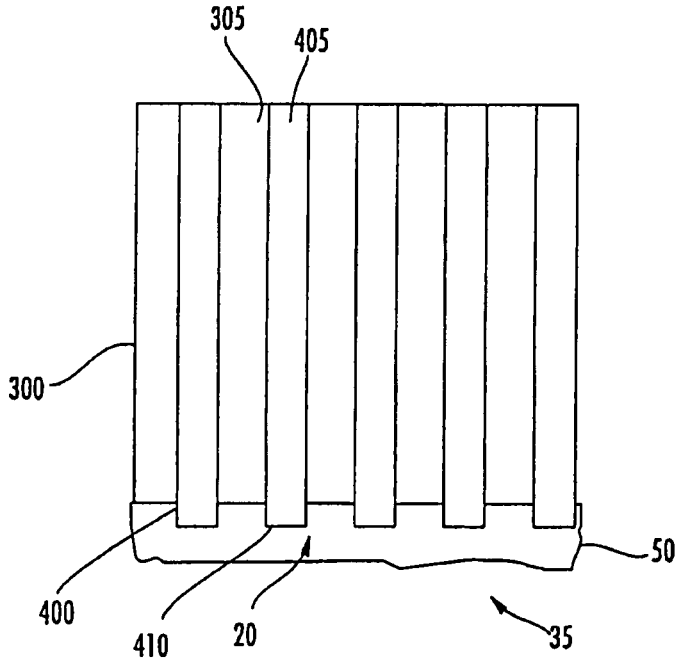
FIG. 4 is an enlarged cross-sectional view of portion A of the component of FIG. 2 showing another exemplary embodiment of the stacked laminate construction of the invention without the fiber overwrap.

Referring to FIG. 4, ring seal segment 10 can have layers 300 and 400 with differing properties that allow for selective control of the properties in different portions of the ring seal segment 10. For example, layer 300 can be a CMC having high temperature tolerances and strength such as the A-N720 described above. Layer 400 can be a material having higher creep deformation resistance than that of layer 300. For example, layer 400 can be a sapphire fiber felt such as one made by Foster-Miller, a mullite whisker felt such as one made by NSWC, or other highly creep resistant materials. Additionally, layer 400 can have the same nominal composition as layer 300, but processed to a higher temperature. Coarsening of grain structure by such higher temperature processing can reduce strength, but will impart improved creep resistance for layer 400. Layer 400 can also be a continuous fiber CMC with additions of single crystal fibers of whiskers. Such materials of layer 400 can be stacked with layer 300 to mitigate against creep deformation.

To enhance the bond between the coating 50 and the inner sealing surface 20 of the ring seal segment 10, the ends 410 of layers 400 can protrude into the coating. Such an arrangement provides greater surface area for adhesion of the coating 50 to the inner sealing surface 20, as well as a mechanical lock of the stronger layers 400 with the coating. The ends 305 and 405 of the layers 300 and 400 can be flush with each other as shown in FIG. 3 or can be offset.

FIG. 4 shows layers 300 and 400 arranged in alternating columns. However, the present disclosure contemplates the use of other patterns of layers 300 and 400. This is especially significant where costly material, such as a sapphire fiber felt, is being used for layer 400. For example, the sapphire fiber felt of layers 400 or any other creep resistant material, can be positioned along the critical portions of the ring seal segment 10 where creep deformation is at its highest and can be used sparingly, if at all, along those portions of the ring seal segment 10 where creep deformation is at its lowest. As described above, ring seal segment 10 can also have more than two layers of different materials. The particular arrangement of layering can be chosen to focus the superior properties of the materials on those portions of the ring seal segment 10 that can take the most advantage of the properties. Ring seal segment 10 can have layers 300 and 400 of substantially equal thickness. However, the present disclosure contemplates the use of varying thicknesses of layers 300 and 400. Similarly, the thickness of layer 100 or the thickness of any additional layers of materials that are utilized can be varied.

The processing of layers 100, 200, 300 and/or 400 to form ring seal segment 10 can be any appropriate technique including co-processing, post-process bonding and any combination thereof. Cutting techniques such as water jet cutting and laser cutting can be used to form the final shape of the gas turbine component such as forming the ring seal segments 10 described above.

Other types of ceramic materials can be used for layers 100, 200, 300 and/or 400, as well as any additional layers that are being utilized in the gas turbine component. Examples of such ceramic materials can include, but are not limited to, cerium oxide, alumina, zirconia, glass, silicon carbide, silicon nitride, sapphire, cordierite, mullite, magnesium oxide, zirconium oxide, boron carbide, aluminum oxide, tin oxide, scandium oxide, hafnium oxide, yttrium oxide, spinel, garnet, steatite, lava, aluminum nitride, iron oxide, aluminosilicate, porcelain, forsterite or combinations thereof, as well as any other crystalline inorganic nonmetallic material or clay. Other types of non-ceramic materials can also be used for layers 200 and/or 400, as well as any additional layers that are being utilized in the gas turbine component.

The ring seal segment 10 can include the use of a strengthening mechanism 500 selected to provide reinforcement to the ring seal segment to increase the strength of the layers 100, 200, 300 and/or 400, an example of which is shown in FIG. 2. The strengthening mechanism 500 can be selected such that it is located within one or more locations of the ceramic article. As such, the ring seal segment 10 or other gas turbine component structured in accordance with the exemplary embodiments, can be used as a replacement for one or more parts in a turbine system that are typically metal, thereby enabling the greater temperature capacity of the ceramic materials to be utilized such that the efficiencies of the turbine systems can be increased relative to prior art systems.

The strengthening mechanism 500 is selected to be positioned with respect to the ring seal segment 10 to help reinforce the segment and/or prevent delamination of the CMC layers that compose the segment. Therefore, the strengthening mechanism 500 serves to reinforce the layers 100, 200, 300 and/or 400, especially normal to the plane of the layers and/or to help inhibit separation of the layers. The number, size, shape and location of the strengthening mechanisms 500 used can be optimized based upon one or more factors including, but not limited to, the local stresses to be applied to the ring seal segments 10, the materials used for layers 100, 200, 300 and/or 400 and/or the type of strengthening mechanism 14.

The strengthening mechanisms 500 can place the layers 100, 200, 300 and/or 400 under compression in a direction generally parallel to the inner sealing surface 20 of the ring seal segment 10. In one embodiment, the strengthening mechanism 500 can be a CMC over-wrap that is wrapped around a portion of the ring seal segments 10. The over-wrap 500 can be composed of a ceramic matrix composite material or other appropriate materials. As shown in FIG. 2, the over-wrap 500 can be in the form of a fiber, a sheet, a fabric, a tow, braided strips or other appropriate materials. A combination of different over-wraps 500 can also be used. The over-wrap 500 can be placed around the ceramic article in one or more locations to help reinforce the ring seal segment 10. The over-wrap 500 can be placed around the ring seal segment 10 after formation of the ring seal segment or during processing or formation of the ring seal segment. In one embodiment, the over-wrap 500 is placed around the ring seal segment 10 after the ring seal segment is fully or nearly fully fired such that the natural shrinkage of the CMC over-wrap, such as during a secondary processing, can be used to induce residual compressive stress on the ring seal segment.

For example, A-N720 CMC can be used to form the over-wrap 500. When the over-wrap 500 is placed onto the fully fired layers 100, 200, 300 and/or 400, the over-wrap can result in a differential shrinkage strain of 0.1% to 0.3%, depending on the firing temperature of the final assembly. This strain can impose an interlaminar compressive stress on the laminate stack, thus adding to the load-carrying capability in this direction. The CMC over-wrap 500 can also be formed from a material having a higher coefficient of thermal expansion than layers 100, 200, 300 and/or 400. In this embodiment, during secondary processing, the overwrap shrinks to compressively load the stacked laminate structure. During cool-down, the compressive load is relaxed and will eventually transform to a zero compressive load at room temperature. However, during operation, the stacked laminate structure is at a higher temperature than the overwrap. This temperature differential results in the overwrap maintaining a compressive load on the stacked laminate structure.

In addition, the CMC over-wrap 500 can be formed from a different composition with different sintering shrinkage than the layers 100, 200, 300 and/or 400, such as a material with a greater sintering shrinkage. The process of coupling the over-wrap 500 to the layers 100, 200, 300 and/or 400 can include securing the layers together with at least one strengthening mechanism 500 and applying a processing temperature to the over-wrap to provide a defined shrinkage differential and compressive preload to the plurality of layers. The over-wrap 500 and the layers 100, 200, 300 and/or 400 can also be subjected to an intermediate firing stage before application of the over-wrap so that shrinkage can be controlled at final firing of the ring seal segment 10.

In an alternative embodiment, alternative fibers can be used for the over-wrap material 500 to achieve further shrinkage and/or coefficient of thermal expansion (CTE) mismatch pre-stressing. For example, in the case above, if the overwrap fiber is NEXTEL 610 alumina, with a higher CTE than NEXTEL 720 mullite fiber, a differential shrinkage of 0.2% to 1.0% can be achieved by a combination of CTE and sintering shrinkage. In some embodiments, the over-wrap 500 can be located in, or adjacent to, regions of interlaminar tensile stress. For thermally induced stresses, it can be beneficial to locate the overwrap 500 around the neutral axis of bending.

In another embodiment, the over-wrap material 500 can be processed after placement on the ring seal segment 10. This secondary processing can be used to permit for alternative CMC materials to be used for the over-wrap 500, particularly if the over-wrap is to be located within a cooler region removed from the inner sealing surface 20 of the ring seal segment 10 when in use. For example, an aluminosilicate matrix material having superior bond strength and increased shrinkage can be used in the cooler regions of the over-wrap 500.

The foregoing is provided for purposes of illustrating, explaining, and describing embodiments of this invention. Modifications and adaptations to these embodiments will be apparent to those skilled in the art and may be made without departing from the scope or spirit of this invention.

We claim:

1. A gas turbine component exposed to a hot gas path of a gas turbine, the component comprising:

a body formed by a process of stacking and laminating layers with a radially inner surface along the radially outer boundary of the hot gas path and a radially outer surface, the body being formed at least in part by a plurality of layers;

wherein each layer has a height dimension extending orthogonal to the radially inner surface that is greater than a width dimension extending parallel to the radially inner surface, thereby causing each of the layers to be positioned substantially orthogonal to the radially inner surface; and wherein the plurality of layers being at least a first layer formed from a first material and a second layer formed from a second material, wherein the first material is a ceramic matrix composite;

wherein the second material has a higher resistance to creep deformation than the first material.

2. The component of claim 1, wherein the second material has a higher thermal conductivity than the first material.

3. The component of claim 1, wherein the second layer is recessed from the first layer along the radially inner surface.

4. The component of claim 1, wherein the first layer is recessed from the second layer along the radially outer surface.

5. The component of claim 1, further comprising a coating on the radially inner surface, wherein the first layer is recessed from the second layer along the radially inner surface and wherein the second layer extends into the coating.

6. A gas turbine component exposed to a hot gas path of a gas turbine, the component comprising:

a body formed by a process of stacking and laminating layers with a radially inner surface along the radially outer boundary of the hot gas path and a radially outer surface, the body being formed at least in part by a plurality of layers;

wherein each layer has a height dimension extending orthogonal to the radially inner surface that is greater than a width dimension extending parallel to the radially inner surface, thereby causing each of the layers to be positioned substantially orthogonal to the radially inner surface; and wherein the plurality of layers being at least a first layer formed from a first material and a second layer formed from a second material, wherein the first material is a ceramic matrix composite;

wherein the second material is a ceramic matrix composite.

7. A gas turbine component exposed to a hot gas path of a gas turbine, the component comprising:

a body formed by a process of stacking and laminating layers with a radially inner surface along the radially outer boundary of the hot gas path and a radially outer surface, the body being formed at least in part by a plurality of layers;

wherein each layer has a height dimension extending orthogonal to the radially inner surface that is greater than a width dimension extending parallel to the radially inner surface, thereby causing each of the layers to be positioned substantially orthogonal to the radially inner surface; and wherein the plurality of layers being at least a first layer formed from a first material and a second layer formed from a second material, wherein the first material is a ceramic matrix composite;

wherein the first and second layers each comprise a plurality of first and second layers that are positioned in an alternating pattern along the body.

8. A gas turbine component exposed to a hot gas path of a gas turbine, the component comprising:

a body formed by a process of stacking and laminating layers with a radially inner surface along the hot gas path and a radially outer surface, the body being formed at least in part by a plurality of layers;

wherein each layer has a height dimension extending orthogonal to the radially inner surface that is greater than a width dimension extending parallel to the radially inner surface, thereby causing each of the layers to be positioned substantially orthogonal to the radially inner surface;

wherein the plurality of layers being at least a first layer formed from a first material and a second layer formed from a second material, wherein the first material is a ceramic matrix composite; and a coating on the radially inner surface, wherein the first layer extends into the coating.

9. A gas turbine component exposed to a hot gas path of a gas turbine, the component comprising:

a body formed by a process of stacking and laminating layers with a radially inner surface along the hot gas path and a radially outer surface, the body being formed at least in part by a plurality of layers;

wherein each layer has a height dimension extending orthogonal to the radially inner surface that is greater than a width dimension extending parallel to the radially inner surface, thereby causing each of the layers to be positioned substantially orthogonal to the radially inner surface;

wherein the plurality of layers being at least a first layer formed from a first material and a second layer formed from a second material, wherein the first material is a ceramic matrix composite; and an overwrap that provides a compressive preload on the body.

10. The component of claim 9, wherein the overwrap is a ceramic matrix composite.

11. The component of claim 9, wherein the overwrap is formed from one of a first overwrap material having a higher coefficient of thermal expansion and a higher secondary processing shrinkage than the plurality of layers, a second overwrap material having a lower coefficient of thermal expansion and a higher secondary processing shrinkage than the plurality of layers or a third overwrap material having a substantially similar coefficient of thermal expansion and a higher secondary processing shrinkage than the plurality of layers.

12. A gas turbine component exposed to a hot gas path of a gas turbine, the component comprising:

a body formed by a process of stacking and laminating layers to define a radially inner surface along the radially outer boundary of the hot gas path;

wherein each layer has a height dimension extending orthogonal to the radially inner surface that is greater than a width dimension extending parallel to the radially inner surface, thereby causing each of the layers to be positioned substantially orthogonal to the radially inner surface;

wherein the layers are formed from at least a first layer of a first material and a second layer of a second material;

wherein at least the first material is a ceramic matrix composite; and wherein the second material has at least one of a higher thermal conductivity or a higher creep strength than the first material.

13. The component of claim 12, wherein the second material is a ceramic matrix composite, a sapphire fiber felt or a mullite whisker felt.

14. The component of claim 12, wherein the first and second layers each comprise a plurality of first and second layers that are positioned in an alternating pattern along at least a portion of the body.

15. The component of claim 12, further comprising a coating on the radially inner surface, wherein the second material has a higher thermal conductivity than the first material, wherein the body has a radially outer surface, wherein the second layer is recessed from the first layer along the radially inner surface, wherein the first layer extends into the coating, and wherein the first layer is recessed from the second layer along the radially outer surface.

16. The component of claim 12, further comprising a coating on the radially inner surface, wherein the second material has a higher creep strength than the first material, wherein the first layer is recessed from the second layer along the radially inner surface and wherein the second layer extends into the coating.

17. The component of claim 12, further comprising a ceramic matrix composite overwrap that provides a compressive preload on the body.

18. A method of manufacturing a gas turbine component comprising:

providing at least a first material and a second material, the first material being a ceramic matrix composite, the second material having at least one of a higher thermal conductivity or a higher creep strength than the first material;

stacking and laminating the first and second materials to define a body comprising layers, the first and second materials being arranged in alternating layers along at least a portion of the body;

cutting the body, wherein each layer has a height dimension extending orthogonal to a radially inner surface that is greater than a width dimension extending parallel to the radially inner surface, thereby causing each of the layers to be positioned substantially orthogonal to a radially inner surface of the body; and applying an overwrap that provides a compressive preload on the body.

19. The method of claim 18, wherein the component is a ring seal segment or a combustor heat shield.

* * * * *